US007872663B2

(12) United States Patent
Chino

(10) Patent No.: US 7,872,663 B2
(45) Date of Patent: Jan. 18, 2011

(54) LIGHT EMITTING DEVICE, IMAGE PROCESSING DEVICE, AND ELECTRONIC APPARATUS

(75) Inventor: Taketo Chino, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 1070 days.

(21) Appl. No.: 11/610,263

(22) Filed: Dec. 13, 2006

(65) Prior Publication Data

US 2007/0176864 A1 Aug. 2, 2007

(30) Foreign Application Priority Data

Jan. 27, 2006 (JP) ..... 2006-018603

(51) Int. Cl.
*B41J 2/435* (2006.01)
*B41J 2/47* (2006.01)
*B41J 2/385* (2006.01)

(52) U.S. Cl. ..... 347/237; 347/236; 347/240; 347/246; 347/247; 347/251; 347/252; 347/253; 347/254; 347/131

(58) Field of Classification Search ..... 347/237, 347/131, 236, 240, 246, 247, 251–254
See application file for complete search history.

(56) References Cited

U.S. PATENT DOCUMENTS 5,959,655 A * 9/1999 Maruo et al. ..... 347/246
6,965,695 B2 11/2005 Yamakawa
2003/0117484 A1* 6/2003 Vazan ..... 347/236

FOREIGN PATENT DOCUMENTS

| | | |
|---|---|---|
| JP | A-63-205237 | 8/1988 |
| JP | A-3-120059 | 5/1991 |
| JP | A-4-148947 | 5/1992 |
| JP | A-2001-268383 | 9/2001 |
| JP | A 2003-118163 | 4/2003 |
| JP | A-2003-140433 | 5/2003 |

* cited by examiner

*Primary Examiner*—Julian D Huffman
*Assistant Examiner*—Sarah Al-Hashimi
(74) *Attorney, Agent, or Firm*—Oliff & Berridge, PLC

(57) ABSTRACT

A light emitting device includes a plurality of light emitting elements, a first storage unit that stores first correction values corresponding to the light emitting elements, a counting unit that counts the number of pixels whose gray-scale values designated by image data are within a predetermined range included in an image, a selection unit that selects a first mode or a second mode according to the relationship between the number counted by the counting unit and a threshold value, and a driving unit that drives the light emitting elements corresponding to the predetermined number of pixels to emit amounts of light corresponding to the first correction values when the first mode is selected by the selection unit, and drives the light emitting elements corresponding to the predetermined number of pixels to emit amounts of light corresponding to the image data when the second mode is selected by the selection unit.

11 Claims, 5 Drawing Sheets

LIGHT EMITTING DEVICE, IMAGE PROCESSING DEVICE, AND ELECTRONIC APPARATUS

BACKGROUND

1. Technical Field

The present invention relates to a technique for controlling the amounts of light emitted from light emitting elements such as organic light-emitting diode (hereinafter, abbreviated as OLED) elements.

2. Related Art

In a light emitting device in which a plurality of light emitting elements are arranged, variation in the amount of light (luminance) among the light emitting elements causes a problem. In order to overcome this problem, for example, JP-A-2003-1118163 discloses a technique that measures the amounts of light emitted from light emitting elements beforehand and that corrects the amounts of light according to the result of measurement.

The characteristics of a light emitting element deteriorate at a speed in accordance with the amount of current supplied to the light emitting element. Therefore, when the amounts of current supplied to a plurality of light emitting elements are corrected according to the characteristics, as in the above-described publication, the characteristics of the light emitting elements deteriorate at different speeds. For example, when the light emitting element has a low luminous efficiency, correction is made to increase the current to be supplied to the light emitting element (that is, correction is made to increase the amount of emitted light). Consequently, deterioration of the characteristics proceeds more quickly than a light emitting element having a high luminous efficiency. When the speed at which the characteristics deteriorate varies among the light emitting elements, as described above, the variation in the characteristics increases with time.

SUMMARY

An advantage of some aspects of the invention is that deterioration of light emitting elements due to correction of the amounts of light is suppressed.

In order to overcome the above-described problems, a light emitting device according to a first aspect of the invention includes a plurality of light emitting elements; a first storage unit (e.g., a ROM 26 and a buffer 321 in FIG. 1) that stores first correction values (e.g., correction values Aa in FIG. 1) corresponding to the light emitting elements: a counting unit (e.g., a control unit 325 in FIG. 1) that counts the number of pixels whose gray-scale values designated by image data are within a predetermined range, the pixels being included in a predetermined number of pixels included in an image; a selection unit (e.g., the control unit 325 in FIG. 1) that selects a, first mode or a second mode according to the relationship between the number counted by the counting unit and a threshold value; and a driving unit (e.g., a correction unit 327 and a driving circuit 24 in FIG. 1) that drives the light emitting elements corresponding to the predetermined number of pixels so as to emit amounts of light corresponding to the first correction values stored in the first storage unit and the image data when the first mode is selected by the selection unit, and that drives the light emitting elements corresponding to the predetermined number of pixels so as to emit amounts of light corresponding to the image data when the second mode is selected by the selection unit. In the invention, "a plurality of light emitting elements" may include all light emitting elements provided in the light emitting device, or some of the light emitting elements.

In this case, the first mode or the second mode is selected according to the relationship between the number of pixels having gray-scale values within a predetermined range, of a predetermined number of pixels, and a threshold value. When the first mode is selected, the light emitting elements emit amounts of light corrected by the first correction values. Therefore, the variation in the amount of light (luminance) among the light emitting elements can be suppressed by properly setting the first correction values in accordance with the characteristics of the light emitting elements. In contrast, when the second mode is selected, the amounts of light are not corrected by the first correction values. Therefore, deterioration of the light emitting elements due to correction by the first correction values can be made less than in the case in which the amount of light from each light emitting element is fixedly corrected by one correction value predetermined on the basis of the characteristics of the light emitting element (that is, the amount of light is forcibly corrected by one correction value, regardless of the gray-scale value of the pixel).

Preferably, the driving unit drives the light emitting elements corresponding to the predetermined number of pixels so as to emit amounts of light only corresponding to the image data on the pixels when the second mode is selected. That is, the amounts of light are not corrected for the predetermined number of pixels. This simplifies the operation of the driving unit in the second mode.

The light emitting device may further include a second storage unit (e.g., a ROM 26 and a buffer 322 in FIG. 5) that stores second correction values corresponding to the light emitting elements, and the driving unit may drive the light emitting elements so as to emit amounts of light corresponding to the second correction values stored in the second storage unit and the image data when the second mode is selected. That is, in the second mode, the amounts of light from the light emitting elements are corrected in a manner different from that in the first mode. In this case, the variation in the amount of light among the light emitting elements can be suppressed not only in the first mode, but also in the second mode.

Preferably, the first correction values and the second correction values are determined so that a range (e.g., a range R2 in FIG. 6) in which the amounts of light from the light emitting elements are distributed in the second mode is wider than a range (e.g., a range R1 in FIG. 6) in which the amounts of light are distributed in the first mode when the same gray-scale value is designated for the predetermined number of light emitting elements. That is, the first correction values and the second correction values are determined so that a difference between the largest one and the smallest one of the amounts of light from the predetermined number of light emitting elements in the first mode is smaller than a difference between the largest one and the smallest one of the amounts of light in the second mode when the same gray-scale value is designated for the light emitting elements. This can suppress deterioration of the characteristics of the light emitting elements resulting from the first correction values.

Preferably, the driving unit includes a correction unit (e.g., a correction unit 327 in FIGS. 1 and 5) for correcting the image data on the pixels, and a driving circuit (e.g., a driving circuit 24 in FIGS. 1 and 5) for driving the light emitting elements so as to emit light according to the corrected image data. When the first mode is selected, the correction unit performs a predetermined calculation using the image data on the pixels and the first correction values (e.g., addition of the image data and the first correction values), and outputs the image data to the driving circuit after calculation. When the second mode is selected, the correction unit outputs the image data on the pixels unchanged to the driving circuit. Alternatively, when the second mode is selected, the correction unit performs a predetermined calculation using the image data on the pixels and the second correction values, and outputs the image data to the driving circuit after calculation. The driving circuit drives the light emitting elements by outputting driving signals having levels (currents or voltages) or pulse widths based on the image data output from the correction unit.

It is satisfactory as long as the light emitting device of the invention has a function of driving the light emitting elements on the basis of the image data on the pixels and the first correction values, and the light emitting device does not necessarily need to have a function of performing a calculation using the image data and the first correction values. For example, when the first mode is selected, the driving unit may adjust the levels or pulse widths of driving signals based on the image data (driving signals having levels or pulse widths based on the image data) by the first correction values, and then output the driving signals to the light emitting elements. Further, when the second mode is selected, the driving circuit may output driving signals having levels or pulse widths only based on the image data on the pixels to the light emitting elements. Alternatively, when the second mode is selected, the driving circuit may adjust levels or pulse widths of driving signals on the basis of the image data according to the second correction values, and then output the driving signals to the light emitting elements.

In a first example, the counting unit may count the number of pixels whose gray-scale values (e.g., a gray-scale value 0 in the following embodiments) designated by the image data correspond to turn-off of the light emitting elements, of the predetermined number of pixels (e.g., Steps S1*a* to Sa6 in FIG. 2), and the selection unit selects the first mode when the number counted by the counting unit is less than the threshold value (e.g., Step Sa7 in FIG. 2), and selects the second mode when the number exceeds the threshold value (e.g., Step Sa5 in FIG. 2). In this case, it is only necessary to determine whether the gray-scale values designated for the light emitting elements correspond to turn-off of the light emitting elements. Therefore, the configuration of the counting unit is simplified.

More preferably, the counting unit sequentially selects the predetermined number of pixels (e.g., Step Sa1 in FIG. 2), and increases the counted number when the gray-scale value of the selected pixel corresponds to turn-off of the light emitting elements (e.g., Step Sa3 in FIG. 2). The selection unit selects the second mode when the number counted by the counting unit exceeds the threshold value. In this case, since the second mode is selected when the number counted by the counting unit exceeds the threshold value (that is, even when determination of the gray-scale values for all the predetermined number of pixels has not been completed), the correction of the amounts of light from the light emitting elements can be started more swiftly than in the case in which the mode is selected only after determination of the gray-scale values for all the pixels has been completed.

In a second example, the counting unit may count the number of successive pixels whose gray-scale values designated by the image data are within a predetermined range (e.g., pixels whose designated gray-scale values are other than 0 in the following embodiment) of the predetermined number of pixels included in the image. In this case, since the mode is selected according to the number of successive pixels whose gray-scale values are within the predetermined range, it is possible to more properly determine according to the contents of the image whether to execute correction by the first correction values, than in the case in which the number of pixels is simply counted as in the first example.

More specifically, the counting unit counts the number of successive pixels whose designated gray-scale values correspond to turn-on of the light emitting elements (e.g., Steps Sb1 to Sb6 in FIG. 3), and the selection unit selects the first mode when the number counted by the counting unit is greater than a threshold value (e.g., Step Sb5 in FIG. 3), and selects the second mode when the counted number is less than or equal to the threshold value (e.g., Step Sb7 in FIG. 3).

More preferably, the counting unit sequentially selects the predetermined number of pixels (e.g., Step Sb1 in FIG. 3), and increases the counted number when the designated gray-scale value of the selected pixel corresponds to turn-on of the light emitting elements (e.g., Step Sb3 in FIG. 3) and the selection unit selects the first mode when the number counted by the counting unit exceeds the threshold value. In this case, since the first mode is selected when the counted number exceeds the threshold value (that is, even when determination of the gray-scale value for all the predetermined number of pixels has not been completed), the correction of the amounts of light from the light emitting elements can be started more swiftly than the case in which the mode is selected only after determination of the gray-scale values for all the pixels has been completed.

In the invention, a combination of the above-described first and second examples is adopted suitably. In this case, the counting unit includes a first counter that counts the number of pixels whose designated gray-scale values correspond to turn-off of the light emitting elements, of the predetermined number of pixels, and a second counter that counts the number of successive pixels whose designated gray-scale values corresponding to turn-on of the light emitting elements, of the predetermined number of pixels. The selection unit selects the first mode or the second mode according to the relationship between the number counted the first counter and a first threshold value and the relationship between the number counted by the second counter and a second threshold value. This makes it is possible to more properly determine whether to execute correction by the first correction values.

Preferably, the counting unit counts the number of pixels whose designated gray-scale values are within the predetermined range, in each of a plurality of divisions of the image, and the selection unit selects the first mode or the second mode in each of the divisions on the basis of the number counted by the counting unit. In this case, it is possible to finely determine whether to execute the correction by the first correction values in each division of the image. Therefore, the desired advantage of the invention can be more marked, that is, the amount of light emitted from the light emitting elements can be made uniform by correction, and deterioration of the light emitting elements resulting from the correction can be suppressed.

More preferably, the image includes a plurality of lines arranged in a first direction (e.g., a sub-scanning direction), and each of the lines includes a plurality of pixels corresponding to the light emitting elements and arranged in a second direction (e.g., a main scanning direction) orthogonal to the first direction. Each of the divisions of the image includes a predetermined number of lines. In this case, since it is determined in each division whether to execute correction by the first correction values, for example, when the pixels belonging to one line correspond to the light emitting elements, the operation of driving the light emitting elements is simplified.

Preferably, the light emitting device of the invention is used in various electronic apparatuses. A typical one of the electronic apparatuses is an image forming apparatus using the light emitting device as an exposure device (exposure head). The image forming apparatus includes an image bearing member (e.g., a photosensitive drum 110 in FIG. 7) having an image forming surface on which a latent image is formed by exposure, the light emitting device of the invention for exposing the image forming surface, and a developing device for forming a developed image by adhering developing agent, such as toner, to the latent image. However, the use of the light emitting device of the invention is not limited to exposure. For example, the light emitting device may be used as a display device in various electronic apparatuses. The electronic apparatuses are, for example, a personal computer and a mobile telephone. The light emitting device is also used as an illumination device, for example, a device (backlight) disposed on the back side of a liquid crystal device to illuminate the liquid crystal device, or a device mounted in an image reading device, such as a scanner, to illuminate a document.

An image processing device according to a second aspect of the invention is used in the above-described light emitting device. The image processing device includes a first storage unit (e.g., a controller 32 in FIG. 1) that stores first correction values corresponding to a plurality of light emitting elements, a counting unit (e.g., the control unit 325 in FIG. 1) that counts the number of pixels whose gray-scale values designated by image data are within a predetermined range, the pixels being included in a predetermined number of pixels included in an image, a selection unit (e.g., the control unit 325 in FIG. 1) that selects a first mode or a second mode according to the relationship between the number counted by the counting unit and a threshold value, and a correction unit (e.g., a correction unit 327 in FIG. 1) that outputs the image data on the predetermined number of pixels to the light emitting elements after correcting the image data by the first correction values stored in the first storage unit when the first mode is selected by the selection unit, and that outputs the image data on the predetermined number of pixels to the light emitting elements without correcting the image data by the first correction values (except for correction by correction values other than the first correction values) when the second mode is selected by the selection unit. The image processing device also provides functions and advantages similar to those of the light emitting device of the invention. The image processing device may be realized by hardware, such as a DSP (digital signal processor), alone, or by a combination of a computer, such as a CPU (central processing unit), and software.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

The configuration of a light emitting device according to a first embodiment of the invention will be described. This light emitting device is used as an exposure device that exposes a photosensitive drum so as to form a latent image thereon in an image forming apparatus (printing apparatus). In the first embodiment, it is assumed that an image (latent image) to be formed is composed of m rows and n columns of pixels (m and n are natural numbers). Hereinafter, a set of n-number of pixels arrayed in a main scanning direction (along the rotation axis of the photosensitive drum) in one image is referred to as a "line".

Figure 1:
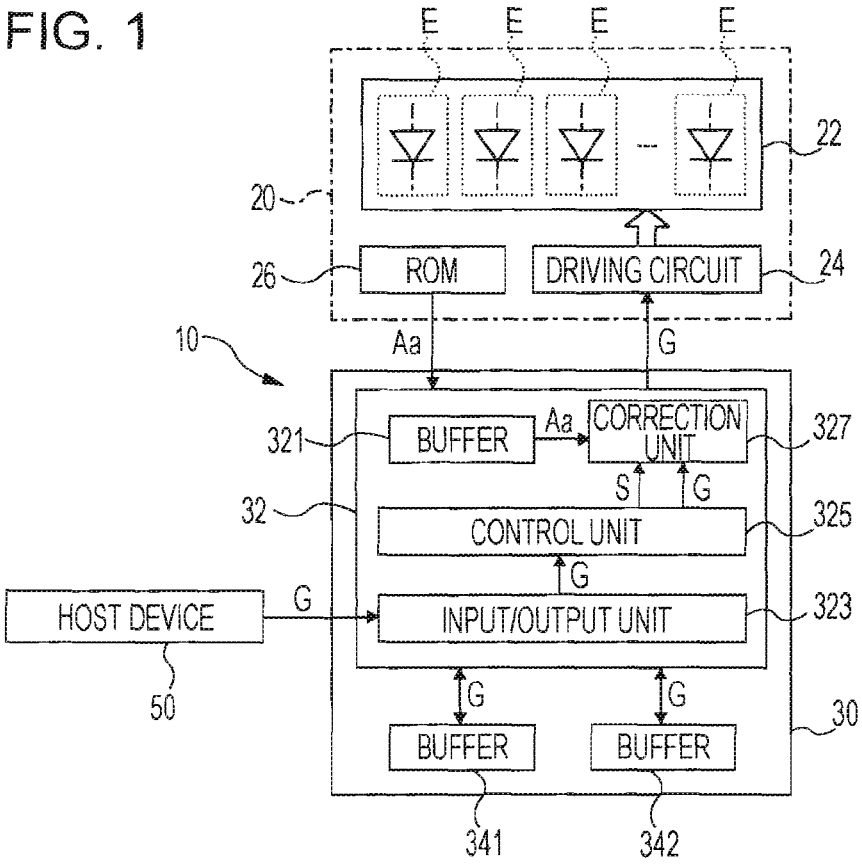
FIG. 1 is a block diagram showing the configuration of a light emitting device according to a first embodiment of the invention.

FIG. 1 is a block diagram showing the configuration of the light emitting device according to the first embodiment. As shown in FIG. 1, a light emitting device 10 includes a head module 20 and a control board 30. The head module 20 emits a light beam onto the surface of the photosensitive drum according to a desired image, and includes an optical head 22, a driving circuit 24, and a ROM 26. In the optical head 22, n-number of light emitting elements E corresponding to pixels in one line of an image are arranged in the main scanning direction. Each of the light emitting elements E is an OLED element in which a light-emitting layer formed of an organic EL (electroluminescence) material is provided between an anode and a cathode, and emits an amount of light corresponding to a driving current supplied to the light-emitting layer.

The driving circuit 24 drives each light emitting element E to emit an amount of light corresponding to image data G. The image data G is digital data that designates any of a plurality of gray-scale values for the light emitting element E. A gray-scale value 0 directs that the light emitting element E is turned off (that is, black), and the other gray-scale values (values larger than 0) direct that the light emitting element E is lighted to emit amounts of light corresponding to the gray-scale values. The driving circuit 24 controls the amount of light from the light emitting element E by controlling the pulse width of a driving current on the basis of the image data G (gradation control by pulse-width modulation). By rotating the photosensitive drum in a sub-scanning direction while thus controlling the amount of light from each light emitting element E, a latent image for one page composed of m columns and n rows of pixels is formed on the surface of the photosensitive drum.

Errors (variations) can be caused in electric or optical characteristics of the light emitting elements E for various reasons. In the first embodiment, the amount of light from each light emitting element E is corrected by a correction value Aa in order to suppress variations in the amount of light resulting from this error of the characteristics. The correction value Aa is set for each light emitting element E according to the characteristics of the light emitting element E. More specifically, the amounts of light from all light emitting elements E are measured when the same gray-scale value is designated for the light emitting elements E (when the same driving current is supplied to the light emitting elements E), and correction values Aa are determined on the basis of the measurement results (variations in the amount of light before correction) so that all the light emitting elements E can emit an equal amount of light. For example, as the amount of light from the light emitting element E before correction decreases, the correction value Aa for the light emitting element E increases. The ROM 26 shown in FIG. 1 nonvolatilely stores n-number of correction values Aa corresponding to the respective light emitting elements E.

A controller 32 and two buffers 341 and 342 are mounted on the control board 30. The controller 32 controls the operation of the head module 20, and includes a buffer 321, an input/output unit 323, a control unit 325, and a correction unit 327. The controller 32 may be realized by hardware such as a DSP, or by execution of a program with a computer such as a CPU.

When the light emitting device 10 is powered on, correction values Aa for the light emitting elements E are transferred from the ROM 26 in the head module 20 to the controller 32 prior to driving the light emitting elements E. The buffer 321 stores n-number of correction values Aa transferred from the ROM 26. The input/output unit 323 receives image data G from a host device (host computer) 50 such as a CPU of an image forming apparatus in which the light emitting device 10 is installed.

The buffer 341 and the buffer 342 serve as means (line memories) that store image data G on n-number of pixels belonging to one line of an image. The input/output unit 323 alternately writes image data G, which is sequentially supplied from the host device 50, line by line into the buffer 341 and the buffer 342. Image data G on n-number of pixels belonging to each odd-numbered line is written in the buffer 341 and image data G on n-number of pixels belonging to each even-numbered line is written in the buffer 342. Further, the input/output unit 323 alternately reads the image data on the line from the buffers 341 and 342, and outputs the read image data to the control unit 325. That is, in synchronization with horizontal synchronization signals, the input/output unit 323 alternately performs writing of the image data G on the odd-numbered lines in the buffer 341 and reading of the image data G on the even-numbered lines from the buffer 342, and reading of the image data G on the odd-numbered lines from the buffer 341 and writing of the image data G on the even-numbered lines in the buffer 342. Hereinafter, a line whose image data G is read by the input/output unit 323 will particularly be referred to as a target line. M-number of lines that constitute an image are sequentially selected as a target line in the order in which they are arranged in the sub-scanning direction.

The control unit 325 controls the manner in which the amounts of light from the light emitting elements E are corrected (in the first embodiment, determines whether to execute correction) according to the contents of image data G. More specifically, the control unit 325 first counts the number Ca of pixels for which a gray-scale value 0 is designated by image data G, of n-number pixels belonging to a target line, and secondly selects a first mode or a second mode for the line according to the relationship between the count value Ca and a predetermined threshold value THa. In the first mode, image data G on n-number pixels belonging to the target line are corrected by the correction values Aa. In contrast, in the second mode, the image data G on the pixels belonging to the target line are not corrected. The control unit 325 outputs, to the correction unit 327, a correction control signal S for selecting the first mode or the second mode for each line.

Figure 2:
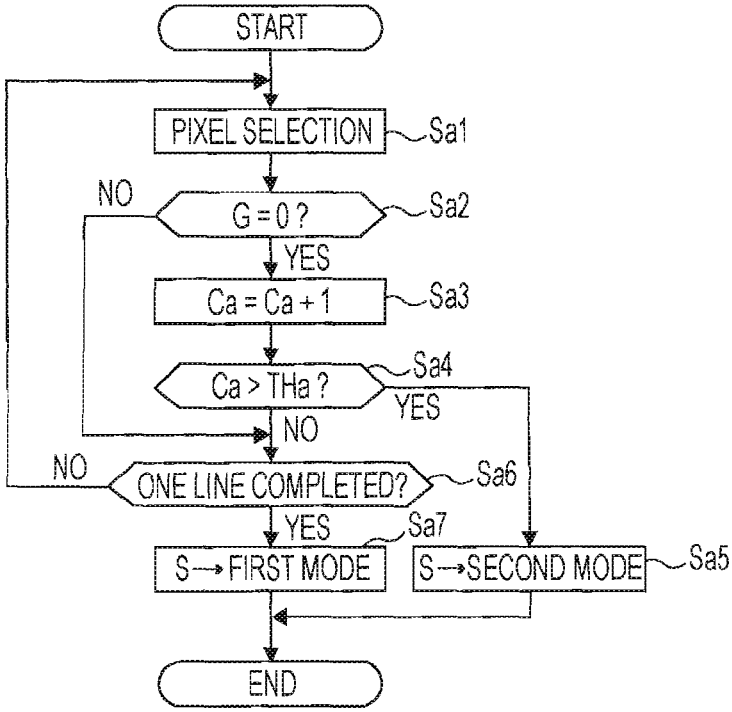
FIG. 2 is a flowchart showing the operation of a control unit in the first embodiment.

FIG. 2 is a flowchart specifically explaining the operation of the control unit 325. A procedure shown in FIG. 2 is performed every time image data G on one target line is supplied from the input/output unit 323 (that is, in synchronization with horizontal synchronization signals). First, the control unit 325 selects one of n-number of pixels belonging to a target line (hereinafter, referred to as a target pixel) (Step Sa1). In the first embodiment, each of the first to n-th pixels are selected as a target pixel in that order in every Step Sa1.

Subsequently, the control unit 325 determines on the basis of image data G whether the gray-scale value of the target pixel is 0 (Step Sa2). When the determination is positive, the control unit 325 increases a count value Ca by one (Step Sa3). That is, the control unit 325 functions as means for counting the number of pixels having the gray-scale value 0 (count value Ca).

Then, the control unit 325 compares the count value Ca updated in Step Sa3 with a predetermined threshold value THa, and determines whether the count value Ca is greater than the threshold value THa (Step Sa4). More specifically, 50 to 60% of the number n of pixels belonging to one line (for example, a value within the range of 2500 to 3000 when n is 5000) is suitably used as the threshold value THa. When the determination in Step Sa4 is positive, (that is, the count value Ca is greater than the threshold value THa), the control unit 325 outputs, to the correction unit 327, a correction control signal S for selecting a second mode for the target line along with the image data G (Step Sa5). In this way, when the count value Ca exceeds the threshold value THa, the second mode is selected and the procedure shown in FIG. 2 is completed even when all pixels in the target line have not been selected as target pixels.

When the determination in Step Sa2 or Step Sa4 is negative, the control unit 325 determines whether all pixels (n-number of pixels) in the target line are selected as target pixels (Step Sa6). When this determination is negative, the control unit 325 selects another pixel as a target pixel (Step Sa1), and conducts Steps Sa2 to Sa4 on this new target pixel. That is, Steps Sa2 to Sa4 are repeated for all pixels in the target line until the count value Ca exceeds the threshold value THa.

When the determination in Step Sa6 is positive, that is, when the number of pixels having a gray-scale value 0, of all pixels in the target line, is smaller than or equal to the threshold value THa, the control unit 325 outputs, to the correction unit 327, a correction control signal S for selecting a first mode for the target line along with the image data G (Step Sa7). As described above, the control unit 325 functions as means for selecting the first mode or the second mode according to the relationship between the count value Ca and the threshold value THa.

The correction unit 327 shown in FIG. 1 processes image data G on the target line supplied from the input/output unit 323 via the control unit, 325 according to the correction control signal S. When the first mode is selected by the correction control signal S, the correction unit 327 performs calculation using the image data C on n-number of pixels in the target line and n-number correction values Aa held in the buffers 321, and outputs the calculated image data G to the head module 20. More specifically, the correction unit 327 adds image data G on the j-th pixel (j is a natural number that satisfies the condition $1 \leqq j \leqq n$) and a correction value Aa corresponding to the j-th light emitting element E, and outputs the added image data G to the driving unit 24. Therefore, in the line of one image in which the first mode is selected, each light emitting element E emits light with an amount corrected by the correction value Aa, thereby forming a latent image on the surface of the photosensitive drum.

In contrast, when the second mode is selected by the correction control signal S, the correction unit 327 outputs the image data G on one line supplied from the control 325 to the driving unit 24 without changing the image data G (that is, without performing calculation using the correction values Aa). Therefore, the light emitting elements E emit amounts of light only corresponding to the image data G (uncorrected amounts of light) in the line of one image in which the second mode is selected, thereby forming a latent image on the surface of the photosensitive drum.

The number of pixels having a gray-scale value 0 tends to be small in an image that is frequently required to be output with high quality, for example, a nature image. Therefore, when this kind of image is formed, the influence of variations in characteristics among the light emitting elements E can be remarkable. In the first embodiment, when the number of pixels having the gray-scale value 0 is smaller than the threshold value THa in a line (for example, a line including a nature image), the amounts of light from the light emitting elements E are corrected by the correction values Aa. Consequently, a high-quality image can be formed with little variation in the amount of light from the light emitting elements E.

In contrast, in an image including many black pixels having a gray-scale value 0 (that is, portions where the leant emitting elements E are turned off), for example, an image in which characters and signs are arranged on a white background (hereinafter, referred to as a text image), the influence of variations in the characteristics among the light emitting elements F on the image quality is less than in the nature image. In the first embodiment, the amounts of light from the light emitting elements E are not corrected in a line in which the number of pixels having the gray-scale value 0 exceeds the threshold value THa (for example, a line including a text image). Therefore, deterioration of the light emitting elements E due to the correction of the amounts of light can be suppressed, compared with the case in which correction is made for all pixels on the basis of correction values Aa selected such that the amounts of light emitted from the light emitting elements E are equal, regardless of the contents of the image.

B. Second Embodiment

A second embodiment of the invention will now be described.

In the above-described first embodiment, it is determined whether to execute correction, according to the relationship between the number Ca of pixels having the gray-scale value 0 in one line and the threshold value THa. In contrast, In the second embodiment, it is determined whether to execute correction (operation mode) according to the number of successive pixels having gray-scale values other than 0 in one line. The configuration of a light emitting device 10 in the second embodiment is similar to that in the first embodiment (FIG. 1). Therefore, the following description will be given with emphasis on processing performed by a control unit 325, and descriptions of points common to the first embodiment will be omitted arbitrarily.

Figure 3:
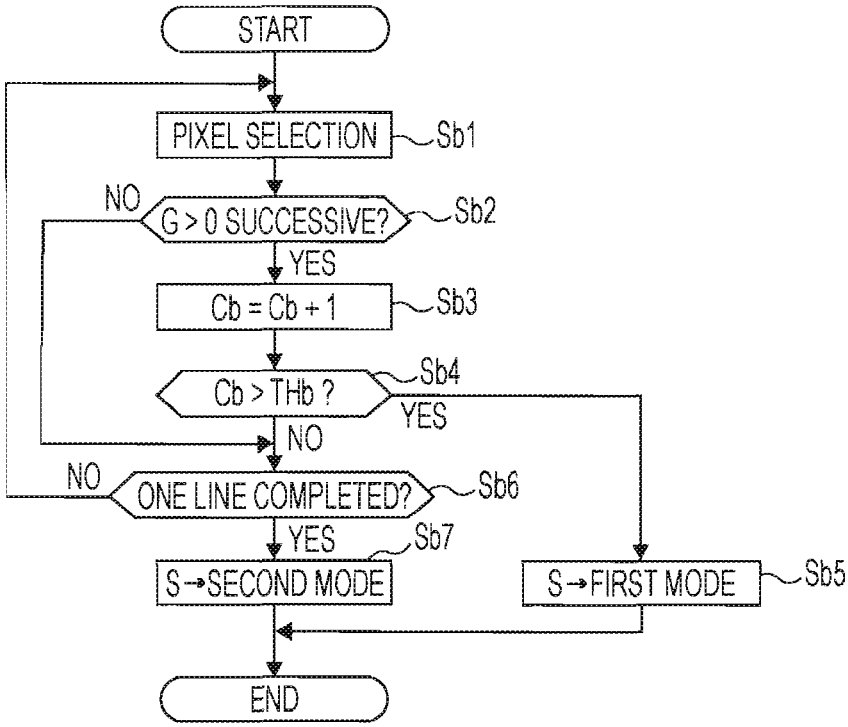
FIG. 3 is a flowchart showing the operation of a control unit in a second embodiment.

FIG. 3 is a flowchart specifically showing a procedure which the control unit 325 performs upon receiving image data G on one line. As shown in FIG. 3, the control unit 325 first selects any pixel in a target line as a target pixel (Step Sb1). Then, the control unit 325 determines whether the gray-scale value of the target pixel is not 0, similarly to the determination made for the gray-scale value of a pixel previously selected as a target pixel (Step Sb2). When the determination is positive, the control unit 325 increases a count value Cb by one (Step Sb3). That is, the control unit 325 according to the second embodiment functions as means for counting the number (count value Cb) of pixels that have gray-scale values other than 0 and are successively disposed in the main scanning direction.

Then, the control unit 325 compares the count value Cb updated in Step Sb3 with a predetermined threshold value THb, and thereby determines whether the count value Cb is greater the threshold value THb (Step Sb4). When the determination in Step Sb4 is positive, that is, when the number of successive pixels having gray-scale values other than 0 in the target line is greater than the threshold value THb, the control unit 325 outputs, to a correction unit 327, a correction control signal S for selecting a first mode for the target line along with image data G on the target line (Step Sb5). In contrast, when the count value Cb is not greater than the threshold value THb, Steps Sb1 to Sb4 are repeated for all pixels in the target line, in a manner similar to that in the first embodiment (Step Sb6: No).

When the count value Cb does not exceed the threshold value THb even when the above-described steps have been conducted for all pixels in the target line (Step Sb6: Yes), the control unit 325 outputs, to the correction unit 327, a correction control signal S for selecting a second mode for the target line along with the image data G on the target line (Step Sb7). Operations of the other elements are similar to those in the first embodiment.

As described above, in the second embodiment, it is also determined whether to execute correction of the amounts of light from the light emitting elements E, according to the contents of the image, and therefore, advantages similar to those in the first embodiment are provided. Further, since the operation mode is determined according to the relationship between the threshold value THb and the number Cb of successive pixels having gray-scale values other than 0, it can be more reliably determined according to the contents of the image whether to execute correction of the amounts of light emitted from the light emitting elements E, than in the first embodiment. This advantage will be described in detail below.

Figure 4:
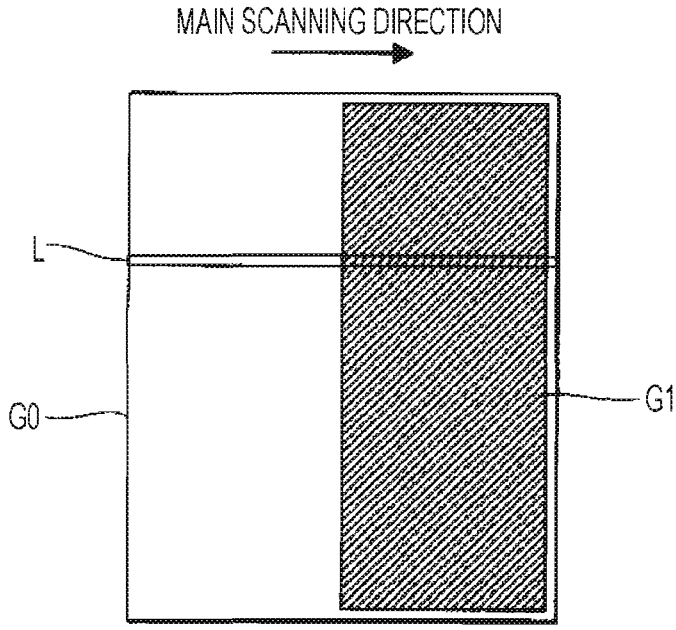
FIG. 4 is a conceptual view illustrating an image including a nature image.

It is assumed that a nature image G1 is provided in the right half of a page of an image G0 having a white background, as shown in FIG. 4. In the first embodiment, if the number of pixels belonging to a white region in the left half of each line L that constitutes the image G0 is greater than the threshold value THa, a second mode is selected for the line L, and the amounts of light from the light emitting elements E are not corrected when forming the line L. Therefore, the nature image G1 In the actually formed image G0 is affected by variations in characteristics among the light emitting elements E.

In contrast in the second embodiment, when the number of pixels in each line L belonging to the nature image G1 is greater than the threshold value THb, the amounts of light from the light emitting elements E are corrected by the correction values Aa when forming the line L. As described above, according to the second embodiment, even the image G0 in which the white region and the other region (the nature image G1) adjoin in the main scanning direction can be properly corrected, and can be output with high quality. However, since it is only necessary to determine whether the gray-scale value is 0 when obtaining the count value Ca in the first embodiment, the procedure performed by the control unit 325 is simpler than in the second embodiment in which the number of successive pixels having gray-scale values other than 0 is counted.

C: Third Embodiment

A third embodiment of the invention will now be described.

In the above-described first and second embodiments, the amounts of light from the light emitting elements E are not corrected when a second mode is selected. In contrast, when the second mode is selected in the third embodiment, the amounts of light from the light emitting elements E are corrected in a manner different from that in the first mode. Components similar to those in the first embodiment are denoted by the same reference numerals as those in FIG. 1, and detailed descriptions thereof are omitted arbitrarily. An operation of the control unit 325 for determining an operation mode is similar to those in the first embodiment (FIG. 2) and the second embodiment (FIG. 3).

Figure 5:
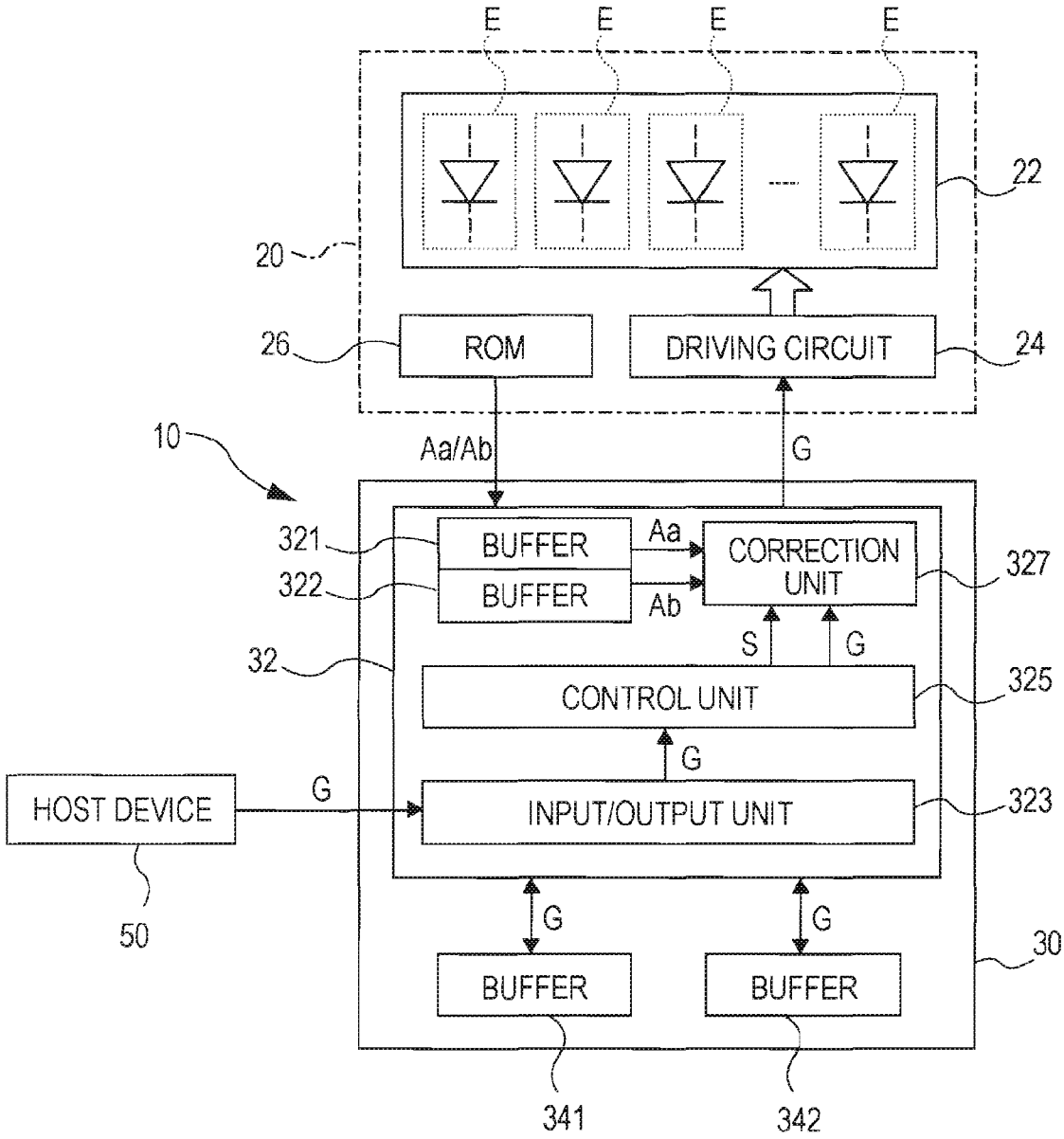
FIG. 5 is a block diagram showing the configuration of a light emitting device according to a third embodiment.

FIG. 5 is a block diagram showing the configuration of a light emitting device 10 according to the third embodiment. As shown in FIG. 5, the light emitting device 10 includes a buffer 322 in addition to the elements adopted in the above-described embodiments. The buffer 322 stores n-number of correction values Ab corresponding to respective light emitting elements E. The correction values Ab are prestored together with correction values Aa in a ROM 26 of a head module 20, and are transferred to the buffer 322 prior to driving the light emitting elements E, similarly to the correction values Aa. The relationship between the correction values Aa and the correction values Ab will be described below.

In the above-described configuration, when a first mode is selected by a control unit 325, a correction unit 327 adds the correction values Aa stored in a buffer 321 and image data G on a target line supplied from the control unit 325 and outputs the sum to a driving unit 24. When a second mode is selected by the control unit 325, the correction unit 327 adds the correction values Ab stored in the buffer 322 and the image data G on the target line supplied from the control unit 325, and outputs the sum to the driving unit 24. As described above, in the third embodiment, the amounts of light from the light emitting elements E are corrected by the correction values Aa when forming lines in the first mode, and are corrected by the correction values Ab when forming lines in the second mode. Therefore, the influence of variations in the characteristics among the light emitting elements E can be reduced. This allows even an image including many white pixels, such as a text image, to maintain a higher quality than in the first and second embodiments.

Figure 6A:
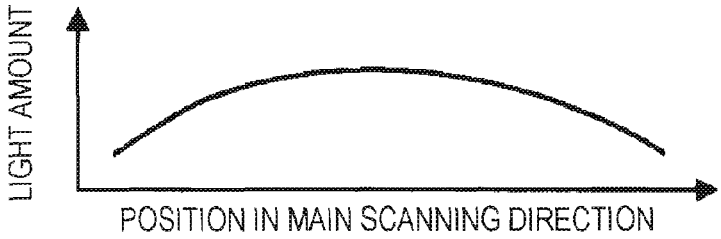
FIG. 6 is a conceptual view showing the distribution of the amounts of light emitted from light emitting elements, and the relationship between correction values Aa and Ab.
Figures 1, 6B:
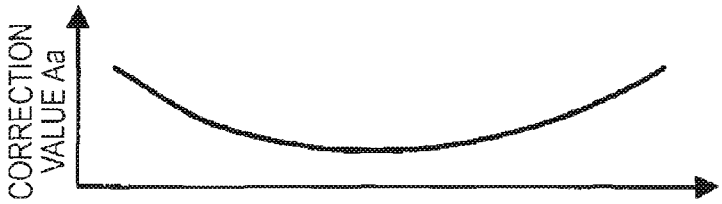
Figures 2, 6B:
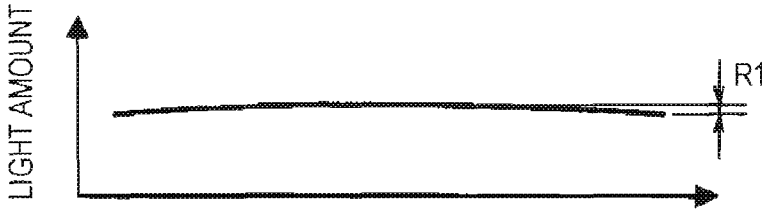

The relationship between the correction values Aa and the correction values Ab will now be described. FIG. 6A is a graph showing the relationship between the positions of the light emitting elements E in the main scanning direction (horizontal axis) and the actual amounts of light emitted from the light emitting elements E when the same gray-scale value is designated (vertical axis) In FIG. 6A, it is assumed that the amount of light emitted from the light emitting element E provided at the center in the main scanning direction of an optical head 22 is larger than the amounts of light emitted from the light emitting elements E provided at both ends, because of variations in the characteristics among the light emitting elements E FIG. 6B-1 is a graph showing the positions of the light emitting elements E and the correction values Aa. FIG. 6B-2 shows the amounts of light emitted from the light emitting elements E that are corrected by the correction values Aa in the first mode. As shown in FIGS. 6B-1 and 6B-2, the correction values Aa are determined so that the amounts of light from the light emitting elements E are made substantially equal by the correction based on the correction values Aa (more strictly, so that the amounts of light are within a range R1).

Figures 1, 6C:
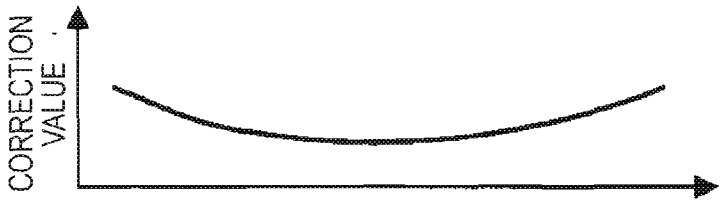
Figures 2, 6C:
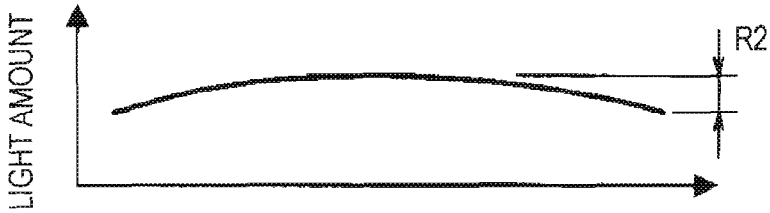

FIG. 6C-1 is a graph showing the relationship between the positions of the light emitting elements E and the correction values Ab. FIG. 6C-2 shows the distribution of the amounts of light from the light emitting elements E that are corrected by the correction values Ab in the second mode. As shown in FIGS. 6C-1 and 6C-2, similarly to the correction values Aa, the correction values Ab are determined so that variations in the actual amounts of light from the light emitting elements F are smaller than before correction (FIG. 6A). However, since the correction values Ab are smaller than the correction values Aa, the amounts of light from the light emitting elements E are not completely equal even after corrected by the correction values Ab, as shown in FIG. 6C-2. That is, in the third embodiment, the correction values Aa and the correction values Ab are determined according to variations in the amounts of light among the light emitting elements E so that a range (range R2 in FIG. 6C-2) in which the amounts of light in the second mode (the amounts of light corrected by the correction values Ab) are distributed is wider than a range (range R1 in FIG. 6B-2) in which the amounts of light in the first mode are distributed.

As described above, in a line in which the second mode is selected, the amounts of light from the light emitting elements E are corrected more gently than when the first mode is selected. Therefore, deterioration of the characteristics of the light emitting elements E can be suppressed, compared with the case in which the correction values Aa selected so as to make the amounts of light equal are adopted for all lines, regardless of the contents of the image.

D: Modifications

Various modifications of the above-described embodiments are possible. Specific modifications will be described below. The following modifications may be combined arbitrarily. In the following description, correction values Aa and correction values Ab are generically referred to as correction values A.

1. First Modification

The above-described embodiments may be combined. For example, the control unit 325 may obtain the count value Ca in the first embodiment and the count value Cb in the second embodiment, and may select the first mode or the second mode according to the relationship between the count value Ca and the threshold value THa and the relationship between the count value Cb and the threshold value THb. More specifically, when determination in Step Sa4 in FIG. 2 is positive (that is, when the number Ca of pixels having a gray-scale value 0 exceeds the threshold value THa), the control unit 325 does not determine the operation mode at that time, but starts the procedure in FIG. 3 after Step Sa4. In this case, since the operation mode is determined in consideration not only of the relationship between the count value Ca and the threshold value THa, but also of the relationship between the count value Cb and the threshold value THb, the amounts of light from the light emitting elements E can be properly corrected even for the image shown in FIG. 4. When the determination in Step Sa6 of FIG. 2 is positive, the control unit 325 selects the first mode for the target line (Step Sa7). Since the procedure shown in FIG. 3 is unnecessary in this case, the burden on processing by the control unit 325 can be reduced.

2. Second Modification

While the ROM 26 storing the correction values A (Aa or Ab) is mounted in the head module 20 in the above-described embodiments, the correction values A may be held in the controller 32 beforehand. Since the correction values A correspond to the characteristics of the light emitting elements E, when light emitting devices in which the correction values A are held in the controller 32 are mass-produced, it is necessary to strictly manage the correspondence between the head module 20 and the controller 32 in each of the light emitting devices. In contrast, in the above-described embodiments in which the correction values A are stored in the head module 20, even when the characteristics of the light emitting elements E differ among the light emitting devices, the controller 32 can be adopted commonly to all the light emitting devices. This eliminates the necessity of managing the correspondence between the head module 20 and the controller 32, and simplifies the manufacturing process of the light emitting devices.

3. Third Modification

While the operation mode is determined for each one line in the above-described embodiments, a region of one image for which the operation mode is determined may be changed arbitrarily. For example, the count value Ca or the count value Cab may be calculated or the operation mode may be selected for each set of lines. Further, the count value Ca or the count value Cb may be calculated or the operation mode may be selected for the entire image. In the first embodiment, for example, the number of pixels having the gray-scale values 0, of all pixels that constitute an image of one page, may be calculated as the count value Ca. This also applies to the count value Cb in the second embodiment. In this case, the first mode or the second mode is selected for the entire page.

4. Fourth Modification

In the above-described embodiments, driving currents having pulse widths corresponding to image data G are supplied to the light emitting elements E. That is, the pulse widths of the driving currents are corrected by the correction values A. However, the object to be controlled according to the image data G is not limited to the pulse width. For example, the values of driving currents supplied to the light emitting elements E or the values of voltages applied to the light emitting elements E (hereinafter, referred to as driving voltages) may be controlled according to the image data G. In other words, the values of driving currents and driving voltages may be corrected by the correction values A.

5. Fifth Modification

While the light emitting device 10 is used to expose the photosensitive drum in the above-described embodiments, it may be used as a device that displays various images. When the light emitting device is used as a display device, a plurality of light emitting elements E are arranged in a matrix with rows and columns, and a selection circuit (scanning-line driving circuit) is provided to sequentially select the light emitting elements E in each line. Driving currents are supplied from the driving circuit 24 to the light emitting elements E in the line selected by the selection circuit, and the light emitting elements E thereby emit amounts of light corresponding to the image data G.

6. Sixth Modification

While the pixels in one line are sequentially selected as a target pixel from the first column to the n-th column in the first embodiment, the order in which the pixels are selected when calculating the count value Ca may be determined arbitrarily. For example, the pixels may be sequentially selected as a target pixel from the n-th row to the first row. Alternatively, n-number of pixels belonging to one line may be divided into N-number of blocks (N is a natural number more than or equal to two), and the pixels may be sequentially selected one by one from the blocks, for example, in the order of the first pixel in the first block, the first pixel in the second block, the second pixel in the first block, and the second pixel in the second block. The direction in which the pixels are selected may vary among the blocks. For example, the pixels may be selected from the first row to the n-th row in each odd-numbered block and from the n-th row to the first row in every even-numbered block.

7. Seventh Modification

While the number Ca of pixels having the gray-scale value 0 is obtained in the first embodiment and the number Cb of successive pixels having gray-scale values other than 0 is obtained in the second embodiment, the range of the gray-scale values of pixels to be counted may be arbitrarily changed in the embodiments. For example, in the first embodiment, the number Ca of pixels having gray-scale values other than 0 may be obtained in Step Sa2, and the second mode may be selected when the count value Ca is less than the threshold value THa (that is, when the number of pixels having the gray-scale value 0 is large) (Step Sa5). Alternatively, the number of pixels whose designated gray-scale values (low gray-scale value including black) are in a predetermined range including 0 may be counted. Similarly, in the second embodiment, the number Cb of successive pixels having a gray-scale value of 0 may be obtained, or the number of pixels having gray-scale values within a range including 0 may be obtained. That is, it is satisfactory as long as the number of pixels having gray-scale values within the predetermined range is obtained. In the invention, the range of the gray-scale values is not specified.

8. Eighth Modification

While OLED elements are used as the light emitting elements E in the above-described embodiments, the light emitting elements adopted in the light emitting device of the invention are not limited thereto. Instead of the OLED elements, the invention can be applied to light emitting devices using various light emitting elements, such as an inorganic EL element, a light emitting diode element, a field emission (FE) element, a surface-conduction electron-emission (SE) element, and a ballistic electron surface emission (BS) element, in a manner similar to those in the above-described embodiments.

E. Electronic Apparatus

A concrete example of an electronic apparatus according to the invention will now be described.

Figure 7:
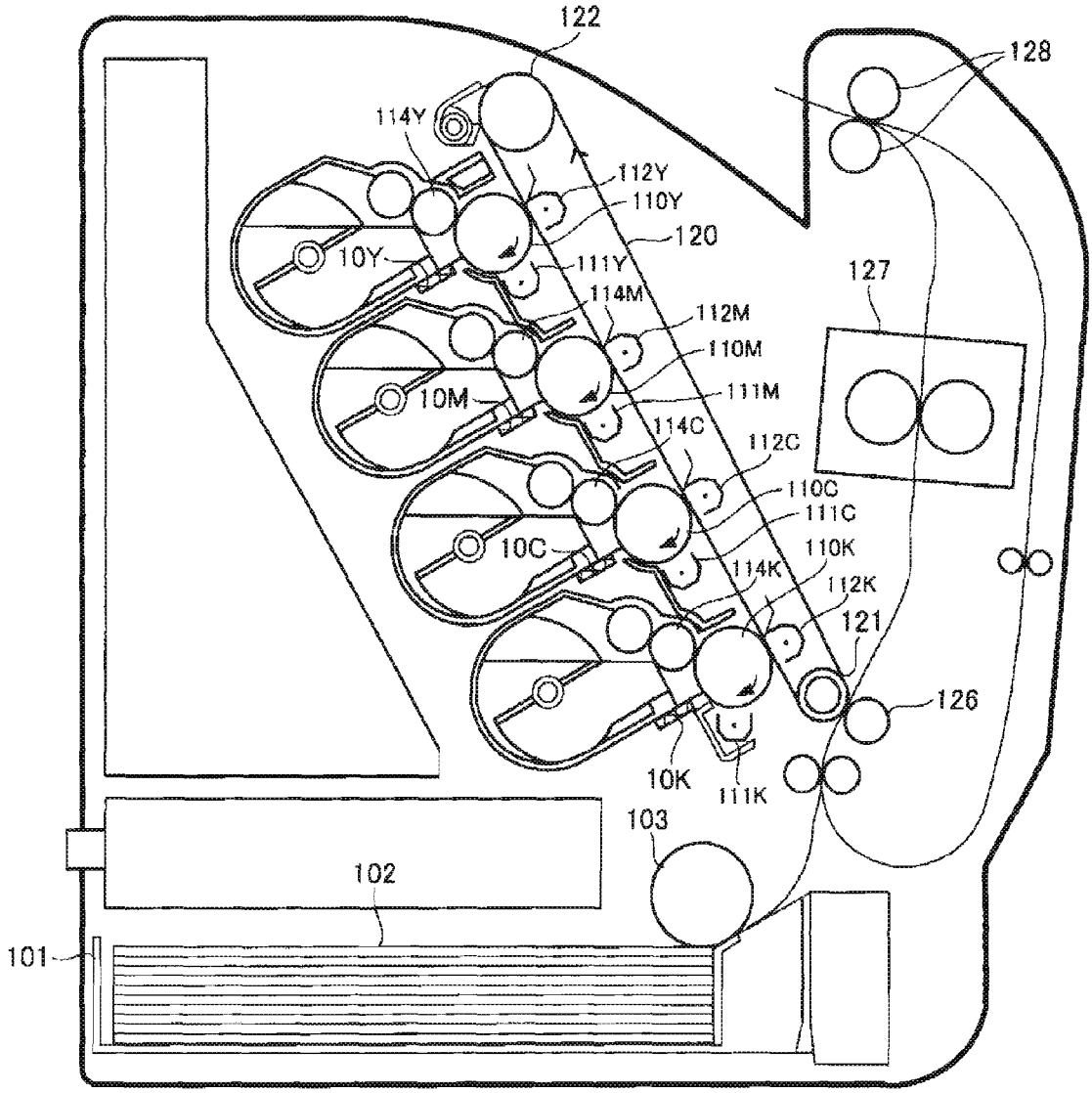
FIG. 7 is a cross-sectional view of a concrete example of an electronic apparatus (image forming apparatus) according to the invention.

FIG. 7 is a cross-sectional view showing the configuration of an image forming apparatus using the light emitting device according to any of the above-described embodiments. The image forming apparatus is of a full-color tandem type, and includes four light emitting devices 10 (10K, 10C, 10M, and 10Y) according to the embodiment and four photosensitive drums 110 (110K, 110C, 110M, and 110Y) corresponding to the light emitting devices 10. Each light emitting device 10 is disposed such as to face an image forming surface (outer peripheral surface) of the corresponding photosensitive drum 110. The letters K, C, M, and Y added to the reference numerals of the elements mean that the elements are used to form black (K), cyan (C), magenta (M), and yellow (Y) latent images.

As shown in FIG. 7, an endless intermediate transfer belt 120 is wound between a driving roller 121 and a driven roller 122. The four photosensitive drums 110 are arranged at regular intervals around t he intermediate transfer belt 120. The photosensitive drums 110 rotate in synchronization with the driving of the intermediate transfer belt 120.

Around each photosensitive drain 110, a corona charger 111 (111K, 111C, 111M, and 111Y) and a developing device 114 (114K, 114C, 114M, and 114Y) are disposed besides the light emitting device 10. The corona charger 111 uniformly charges the image forming surface of the corresponding photosensitive drum 110C. By exposing the charged image forming surface according to image data G by the light emitting device 10, an electrostatic latent image is formed on the surface. The developing device 114 adheres developing agent (toner) onto the electrostatic latent image, thus forming a developed image (visible image) on the photosensitive drum 110.

Developed images of black, cyan, magenta, and yellow colors thus formed on the photosensitive drums 110 are sequentially transferred onto the surface of the intermediate transfer belt 120 (primary transfer) so as to form a full-color developed image. Four primary transfer corotrons (transfer devices) 112 (112K, 112C, 112M, and 112Y) are arranged inside the intermediate transfer belt 120. Each primary transfer corotron 112 electrostatically attracts the developed image from the corresponding photosensitive drum 110, and transfers the image onto the intermediate transfer belt 120 passing between the photosensitive drum 110 and the primary transfer corotron 112.

Sheets (recording materials) 102 are supplied one by one from a sheet cassette 101 by a pickup roller 103, and are conveyed to a nip between the intermediate transfer belt 120 and a secondary transfer roller 126. The full-color developed image formed on the surface of the intermediate transfer belt 120 is transferred onto one side of the sheet 102 by the secondary transfer roller 126 (secondary transfer), passes between a pair of fixing rollers 127, and is thereby fixed on the sheet 102. After the above-described steps, the sheet 102 on which the developed image is fixed is ejected by a pair of ejection rollers 128.

Since the above-described image forming apparatus uses OLED elements as light sources (exposure means), the size of the apparatus can be made smaller than that of an apparatus using a laser scanning optical system. The invention is also applicable to image forming apparatuses having configurations other than the above-described configuration. For example, the light emitting device of the invention can also be applied to a rotary-development type image forming apparatus, an image forming apparatus in which a developed image is directly transferred from the photosensitive drum onto the sheet without using the intermediate transfer belt, or an image forming apparatus that forms a monochromatic image.

The use of the light emitting device of the invention is not limited to exposure of the photosensitive drum. For example, the light emitting device can be adopted as a line optical head (illumination device) for applying light onto an object to be read, such as a document, in an image reading device. This type of reading device is, for example, a scanner, a reading section of a copying machine or a facsimile machine, a barcode reader, or a two-dimensional image code reader that reads a two-dimensional image code such as a QR code (registered trademark). A light emitting device in which a plurality of light emitting elements are arranged in a surface form can also be adopted as a backlight unit disposed on the back side of a liquid crystal panel.

The light emitting device of the invention is also used as a display device in various electronic apparatuses. Examples of electronic apparatuses to which the light emitting device is applied include a portable personal computer, a mobile telephone, a personal digital assistant (PDA), a digital still camera, a television set, a video camera, a car navigation system, a pager, an electronic notebook, electronic paper, a desk-top calculator, a word processor, a workstation, a videophone, a POS terminal, a printer, a scanner, a copying machine, a video player, and an apparatus equipped with a touch panel.

The entire disclosure of Japanese Patent Application No. 2006-018603, filed Jan. 27, 2006 is expressly incorporated by reference herein.

What is claimed is:

1. A light emitting device comprising:

a plurality of light emitting elements;

a first storage unit that stores first correction values corresponding to the light emitting elements;

a counting unit that counts a number of pixels whose gray-scale values designated by image data are within a predetermined range, the pixels being included in a predetermined number of pixels included in an image;

a selection unit that selects a first mode or a second mode according to a relationship between the number of pixels counted by the counting unit and a threshold value; and a driving unit that drives the light emitting elements corresponding to the predetermined number of pixels so as to emit amounts of light corresponding to the first correction values stored in the first storage unit and the image data when the first mode is selected by the selection unit, and that drives the light emitting elements corresponding to the predetermined number of pixels so as to emit amounts of light corresponding to the image data when the second mode is selected by the selection unit.

2. The light emitting device according to claim 1, wherein the driving unit drives the light emitting elements corresponding to the predetermined number of pixels so as to emit amounts of light only corresponding to the image data when the second mode is selected by the selection unit.

3. The light emitting device according to claim 1, further comprising:

a second storage unit that stores second correction values corresponding to the light emitting elements, wherein the driving unit drives the light emitting elements corresponding to the predetermined number of pixels so as to emit amounts of light corresponding to the second correction values stored in the second storage unit and the image data when the second mode is selected by the selection unit.

4. The light emitting device according to claim 3, wherein the first correction values and the second correction values are determined so that a range in which the amounts of light from the light emitting elements are distributed in the second mode is wider than a range in which the amounts of light are distributed in the first mode when the same gray-scale value is designated for the predetermined number of light emitting elements.

5. The light emitting device according to claim 1, wherein the counting unit counts the number of pixels whose gray-scale values designated by the image data correspond to turn-off of the light emitting elements, the pixels being included in the predetermined number of pixels, and wherein the selection unit selects the first mode when the number counted by the counting unit is less than or equal to the threshold value, and selects the second mode when the number is greater than the threshold value.

6. The light emitting device according to claim 5, wherein the counting unit sequentially selects the predetermined number of pixels, and increases the counted number when the gray-scale value of the selected pixel corresponds to turn-off of the light emitting elements, and wherein the selection unit selects the second mode when the number counted by the counting unit exceeds the threshold value.

7. The light emitting device according to claim 1, wherein the counting unit includes a first counter that counts the number of pixels whose gray-scale values correspond to turn-off of the light emitting elements, the pixels being included in the predetermined number of pixels; and a second counter that counts the number of successive pixels whose gray-scale values correspond to turn-on of the lights emitting elements, the successive pixels being included in the predetermined number of pixels, and wherein the selection unit selects the first mode or the second mode according to the relationship between the number counted the first counter and a first threshold value and the relationship between the number counted by the second counter and a second threshold value.

8. The light emitting device according to claim 1, wherein the counting unit counts the number of pixels whose gray-scale values are within the predetermined range, in each of a plurality of divisions of the image, and wherein the selection unit selects the first mode or the second mode in each of the divisions on the basis of the number counted by the counting unit.

9. The light emitting device according to claim 8, wherein the image includes a plurality of lines arranged in a first direction, each of the lines including a plurality of pixels corresponding to the light emitting elements and arranged in a second direction orthogonal to the first direction, and wherein each of the divisions of the image includes a predetermined number of lines.

10. An electronic apparatus comprising the light-emitting device according to claim 1.

11. An image processing device used in a light emitting device in which the amounts of light from a plurality of light emitting elements are controlled according to image data, the image processing device comprising:

a first storage unit that stores first correction values corresponding to the light emitting elements;

a counting unit that counts a number of pixels whose gray-scale values designated by image data are within a predetermined range, the pixels being included in a predetermined number of pixels included in an image;

a selection unit that selects a first mode or a second mode according to a relationship between the number of pixels counted by the counting unit and a threshold value, and a correction unit that outputs image data on the predetermined number of pixels to the light emitting elements after correcting the image data by the first correction values stored in the first storage unit when the first mode is selected by the selection unit, and that outputs the image data on the predetermined number of pixels to the light emitting elements without correcting the image data by the first correction values when the second mode is selected by the selection unit.

* * * * *